US006100005A

United States Patent [19]

Churella et al.

[11] Patent Number: 6,100,005

[45] Date of Patent: Aug. 8, 2000

[54] PHOTOGRAPHIC ELEMENT AND METHOD

[75] Inventors: Daniel J. Churella, Bedford; Wilhelm J. Erdmann, Belmont; Gerard Gomes, West Boylston; John R. Linton, Lincoln; Francis M. Pierce, Groton, all of Mass.

[73] Assignee: Polaroid Corporation, Cambridge, Mass.

[21] Appl. No.: 09/087,123

[22] Filed: May 29, 1998

[51] Int. Cl.[7] ..... G03C 1/775

[52] U.S. Cl. ..... 430/212; 430/218; 430/220; 430/510; 430/523

[58] Field of Search ..... 430/212, 218, 430/220, 510, 523

[56] References Cited

U.S. PATENT DOCUMENTS

| | | | |
|---|---|---|---|
| 3,642,510 | 2/1972 | Sugiyama et al. | 106/300 |
| 3,647,435 | 3/1972 | Land | 96/3 |
| 3,647,437 | 3/1972 | Land | 430/220 |
| 3,833,369 | 9/1974 | Chiklis et al. | 96/3 |
| 4,235,768 | 11/1980 | Ritter et al. | 260/40 R |
| 4,246,040 | 1/1981 | Okumura | 106/308 B |
| 4,367,272 | 1/1983 | Hayashi et al. | 430/220 |
| 4,781,890 | 11/1988 | Arai et al. | 422/56 |
| 4,791,048 | 12/1988 | Hirai et al. | 430/218 |
| 5,422,233 | 6/1995 | Eckert et al. | 430/212 |
| 5,432,043 | 7/1995 | Hayashi | 430/220 |
| 5,468,463 | 11/1995 | Bütje et al. | 423/612 |

FOREIGN PATENT DOCUMENTS

| | | |
|---|---|---|
| 2006711 | 1/1970 | France . |
| 1260528 | 1/1972 | United Kingdom . |

OTHER PUBLICATIONS

Research Disclosure 15162, Nov. 1976.

*Primary Examiner*—Janet Baxter
*Assistant Examiner*—Amanda C. Walke
*Attorney, Agent, or Firm*—Gaetano D. Maccarone

[57] ABSTRACT

There is described a novel diffusion transfer photographic system wherein an exposed diffusion transfer photographic film unit is developed with an aqueous alkaline processing composition in the presence of alumina-free titanium dioxide.

21 Claims, No Drawings

PHOTOGRAPHIC ELEMENT AND METHOD

PHOTOGRAPHIC ELEMENT AND METHOD

This invention relates to novel photographic processing compositions, film units and processes for use in diffusion transfer photographic systems. More particularly, the invention relates to a diffusion transfer photographic system wherein an exposed film unit is processed in the presence of alumina-free titanium dioxide.

BACKGROUND OF THE INVENTION

Diffusion transfer photographic processes are well known in the art. Such processes have in common the feature that the final image is a function of the formation of an imagewise distribution of an image-providing material and the transfer by diffusion of image-providing material imagewise to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing composition to form an imagewise distribution of diffusible image-forming material, and transferring this imagewise distribution by diffusion to the image-receiving layer of a superposed image-receiving element, or positive film component, to form a transfer image thereon.

The aqueous alkaline processing compositions employed in diffusion transfer processes permeate the emulsion layer (s) of the photosensitive element to effect development thereof, and generally comprise aqueous alkaline compositions having a pH in excess of about 10, and frequently in the order of about pH 12 to about pH 14. The processing compositions utilized in diffusion transfer processes generally comprise at least an aqueous dispersion of a highly alkaline material, for example, potassium hydroxide, sodium hydroxide or the like. The processing composition typically includes a light-reflecting pigment such as, for example, titanium dioxide, a thickening agent which is generally a high molecular weight polymer, e.g., a polyacrylic acid, and optical filter agents, as well as, development accelerators, silver solvents, antifoggants, post-process transfer inhibitors, and inorganic materials, such as, for example, silica.

After processing has been allowed to proceed for a predetermined period of time, it is desirable to neutralize the alkali of the processing composition to prevent further development and image material transfer, and, in some instances, subsequent oxidation which may have a material and substantial effect upon the stability to light of the resulting image in the image-receiving layer. Accordingly, a neutralizing layer, typically a nondiffusible acid-reacting material, is typically employed in the film unit to lower the pH from a first (high) pH of the processing composition to a predetermined second (lower) pH. To ensure that the pH reduction occurs after a sufficient, predetermined period and not prematurely so as to interfere with the development process, a timing layer is typically positioned adjacent the neutralization layer.

Diffusion transfer photographic materials known in the art include those wherein the photosensitive silver halide emulsion layer(s) and the image-receiving layer are initially contained in separate elements which are brought into superposition prior or subsequent to, exposure. Alternatively, the photosensitive layer(s) and the image-receiving layer may initially be in a single element wherein the photosensitive and image-receiving components are retained together in an integral negative-positive structure. In either case, after development the two elements may be retained together in a single film unit, commonly referred to as an integral film unit, or separated, commonly referred to as a peel-apart film unit.

The transfer image of an integral film unit may be viewed through a transparent support against a reflecting background, such as, for example, that provided by a dispersion of a white, light-reflecting pigment, e.g., titanium dioxide, and the layer providing the reflecting background is generally positioned between the developed silver halide emulsion layer and the image-receiving layer. As would be appreciated by those of skill in the art, several embodiments of integral film units are known, including, for example, those described in U.S. Pat. Nos. 3,415,644; 3,594,165; 3,647,435; and 3,647,437.

The integral film units described in U.S. Pat. No. 3,415,644 include suitable photosensitive layers and image dye-providing materials carried on an opaque support, an image-receiving layer carried on a transparent support and means for distributing a processing composition between the elements of the film unit. Photoexposure is made through the transparent support and the image-receiving layer, and a processing composition which includes a light-reflecting pigment is distributed between the photosensitive and image-receiving elements. After the distribution of the processing composition and before photographic processing is complete, the film unit can be, and preferably is, transported into the light. Accordingly, in such film units, the layer provided by distributing the light-reflecting pigment must be capable of performing specific and critical assigned functions, including providing suitable protection against further exposure of the photoexposed photosensitive element prior to the completion of processing, allowing suitable effective transfer of the image-forming materials from the photoexposed photosensitive layer to the image-receiving layer, and providing a reflecting background of suitable efficiency for viewing the transferred image. In addition, the reflecting layer serves to mask the developed photosensitive layer(s).

Integral film units described in U.S. Pat. No. 3,594,165 include a transparent support carrying suitable photosensitive layers and associated image dye-providing materials, a permeable opaque layer, a permeable light-reflecting pigment-containing layer, an image-receiving layer viewable through a transparent support against the light-reflecting layer, and means for distributing a processing composition between the photosensitive layer and a transparent cover or spreader sheet. Moreover, the processing composition is opaque and is distributed after photoexposure to provide a second opaque layer which can prevent additional exposure of the photosensitive element. In such film units exposure is made through the transparent support sheet. After distribution of the processing composition and formation of the second opaque layer, the film unit typically is transported into the ambient light before processing is complete. Accordingly, in such film units, the light-reflecting pigment-containing layer also performs the critical tasks referred to above for the film units described in U.S. Pat. No. 3,415,644, and masks the developed photosensitive layer.

It is also well known in the art such as, for example, is described in U.S. Pat. Nos. 3,647,435 and 3,647,437, to include auxiliary opacification systems in such integral film units. The auxiliary opacification systems are designed to cooperate with the light-reflecting layer and/or light-reflecting materials referred to above to provide even more opacity to prevent further exposure of the film unit through the light-reflecting layer during the photographic processing of the film unit in the ambient light.

For example, U.S. Pat. No. 3,647,437 describes an auxiliary opacification system that employs a pH-sensitive, optical filter agent which can absorb light at one pH but is rendered less light-absorbing at another pH. More particularly, the optical filter agent is dispersed in the processing composition together with the light-reflecting pigment. The processing composition is integrated with the elements of the film unit so that the processing composition can be distributed between the photoexposed photosensitive layer and the image-receiving layer. Accordingly, after the distribution of the processing composition, an opaque layer comprising the light-reflecting pigment and the optical filter agent is provided and the opaque layer covers a substantially major surface of the photoexposed layer. During the initial stages of development, the pH-sensitive optical filter agent absorbs light and cooperates with the reflecting pigment to provide a degree of opacity sufficient to prevent substantially any additional photoexposure through the layer. As the transfer of the image-forming materials proceeds, the light-absorbing capability of the pH-sensitive optical filter agent is reduced until the optical filter agent becomes substantially non light-absorbing and its opacification function is terminated. When the transfer of the image-forming material is complete, the light-reflecting layer comprising the light-reflecting pigment and the non light-absorbing optical filter agent provides a reflecting background for viewing the final image.

Importantly, as would be understood by those of skill in the art, to realize the critical functions of the light-reflecting layers described above, the light-reflecting materials comprising the light-reflecting layer must remain substantially uniformly dispersed within the layer distributed from the processing composition and within the processing composition itself prior to and during the distribution thereof. Hence, because premature interactions between the various components of the processing composition resulting in, for example, agglomeration of such components, would interfere with the functions of the composition it is desirable to keep such components uniformly suspended.

Since the processing composition is typically provided in a rupturable container which is a component of the photographic film unit, the composition is required to retain its desired rheological properties during the shelf-life of the film unit. Further, efforts to eliminate the agglomeration of the components in aqueous alkaline processing compositions can be difficult without detrimentally affecting the photographic quality of diffusion transfer film units. In other words, due to the complexity of the chemical interactions between the constituents of the processing composition, as well as, the interactions of the processing composition with the other components of the film unit, including the timely provision of suitable opacification, minor changes in the formulation of the processing composition can have a significant impact on performance of the the resulting photographic product.

There are described various techniques for keeping components of the aqueous alkaline processing compositions dispersed during storage and also for maintaining dispersions of pigments in liquid organic media such as pigmented lacquers and plastic materials. Similarly, in the paint industry, it is known to use a dispersion of titanium dioxide to influence the properties of the products in regard to hue, gloss and physical and chemical behavior. To realize these beneficial effects, the titanium dioxide particles must remain substantially dispersed, i.e., uniformly distributed, in the aqueous alkaline solutions or in the liquid organic media to which they are added.

U.S. Pat. No. 3,642,510 describes a process for preparing titanium oxide pigments which are dispersable in hydrophobic systems such as paints or varnishes by adding an alkali metal salt of a high molecular weight carboxyl compound to a titanium oxide slurry finely dispersed in water or an alcohol containing an aluminum salt or zinc salt to form a soap of aluminum or zinc on the surface of the titanium oxide.

U.S. Pat. No. 4,235,768 describes a process of coating a titanium dioxide pigment with an organic polymer containing carboxyl groups to produce a homogeneous dispersion of the pigment in liquid organic media, e.g., pigmented lacquers and plastic materials.

U.S. Pat. No. 4,246,040 describes a method of surface treating a powdery or granular solid substance such as titanium dioxide which comprises reacting a basic polyaluminum salt with an acid or its salt in the presence of the titanium dioxide to alter the hydrophilic or lipophilic properties of the titanium dioxide.

In addition, methods are known in the art to alleviate or circumvent the undesirable results brought about by the settling or agglomeration of titanium dioxide particles in aqueous alkaline processing compositions, e.g., by self-association or interaction with other components of the processing compositions, for example, by encapsulating the titanium dioxide particles such as disclosed in U.S. Pat. No. 3,833,369; or, by adding additional titanium dioxide particles to the processing composition, so that, in effect, the settling out of the titanium dioxide particles still occurs but the amount present overall provides suitable opacification and reflection.

While such materials have been found to provide advantageous results as are described in the above-mentioned patents; nevertheless, their performance in some photographic systems is not completely satisfactory. In some instances, with integral diffusion transfer film units which are ejected from the camera immediately upon distribution of the processing composition and development is allowed to take place in the ambient light, there have been encountered defects in the final image in the form of small localized spots which have been referred to as pinpoint opacification defects. Also, there have been observed defects in the images obtained from other types of diffusion transfer photographic film units which can be attributed to less than uniform spreading of the processing composition. Hence, as the state of the art for photographic systems advances, novel techniques and materials continue to be developed in order to attain the performance criteria required of such materials. There is a need for novel photographic processing compositions, film units and methods for use in diffusion transfer photographic systems that have advantages over those already known to the art; hence, investigations continue to be pursued to provide such advantages.

SUMMARY OF THE INVENTION

These and other objects and advantages are accomplished in accordance with the invention by providing a diffusion transfer photographic system wherein an exposed diffusion transfer photographic film unit is developed in the presence of alumina-free titanium dioxide. In a particularly preferred embodiment of the invention, the alumina-free titanium dioxide is incorporated in the aqueous alkaline processing composition. In another preferred embodiment the alumina-free titanium dioxide is incorporated in a film unit as a discrete layer.

It should be understood that by "alumina-free titanium dioxide" is meant titanium dioxide which includes only trace amounts of aluminum oxide, for example, from about 0 to about 50 ppm of alkali-extractable aluminum. Such trace amounts of aluminum can be measured by techniques which are commonly practiced in the art such as atomic emission spectroscopy. In contrast to the titanium dioxide heretofore utilized in aqueous alkaline processing compositions wherein aluminum is intentionally added during the manufacturing process to force formation of the rutile crystal structure, aluminum is not intentionally added during the preparation of alumina-free titanium dioxide.

Any exposed diffusion transfer photographic film elements may be processed in accordance with the invention including those where the photosensitive, or negative, element and the image-receiving, or positive, element are retained together after photographic processing ("integral" film units) and those where the photosensitive and image-receiving elements are separated from one another after photographic processing ("peel-apart" film units). The photographic film elements include those which form images in black and white or in color and those wherein the final image is formed in metallic silver or by image-forming materials such as various image dye-providing materials.

It has been found that the use of alumina-free titanium dioxide in the diffusion transfer photographic film system of the invention can substantially eliminate pinpoint opacification defects which may otherwise be present in the final developed image. Further, the use of alumina-free titanium dioxide has been found to provide important advantages in the process for preparing the composition and in the rheological characteristics of the processing composition during storage before the composition is delivered to an exposed photosensitive element to initiate photographic development. The presence of alumina-free titanium dioxide has been found to result in less time-dependent variability in parameters such as the viscosity of the processing composition.

DESCRIPTION OF THE PREFERRED EMBODIMENTS

Alumina-free titanium dioxide which is suitable for use in the present invention is well known and, as such, may be prepared using techniques which are well known in the art. Such techniques are described in, for example, U.S. Pat. Nos. 5,468,463 and 4,781,890. Alumina-free titanium dioxide is commercially available, for example, from Bayer AG under the tradename Bayertitan RUF and from Kronos Co. under the tradename Titanox 2071U. It is preferred to use high rutile, alumina-free titanium dioxide.

The amount of alumina-free titanium dioxide required to provide the light-reflecting function in any particular diffusion transfer photographic film unit is dependent on various factors such as the type of film unit, where the titanium dioxide is initially incorporated in the film unit, e.g. in the processing composition or as a discrete layer in the film unit and the desired results.

The use of alumina-free titanium dioxide in the diffusion transfer photographic system of the invention has been found to substantially eliminate pinpoint opacification defects which might otherwise occur in the final images formed. These advantageous results obtained through the use of alumina-free titanium dioxide are not completely understood. However, to further aid those skilled in the art to better understand and practice the photographic diffusion transfer system of the invention, the proposed theoretical mechanism by which the advantageous results are thought to be effected will be discussed here. It should be understood, however, that the present inventive diffusion transfer photographic system has been proved to be operative and highly effective through extensive experimentation and the proposed theoretical mechanism is not to be construed to be limiting of the invention. It is theorized that the presence of pinpoint opacification defects in the final image is related to the formation of gels in the processing composition during storage and that the use of alumina-free titanium dioxide leads to the formation of lesser amounts of such gels.

Commonly used titanium dioxide typically contains aluminum oxide ($Al_2O_3$), or "alumina", from about 1.2–1.5 percent by weight. The aluminum oxide can dissolve slowly in the highly alkaline composition and interact with other components of the composition such as silica and polymeric thickening agents to form gels which can result in the formation of agglomerates and cause thickening of the composition over time during storage. Where the film unit is allowed to develop in ambient light, such agglomeration and change in the rheological properties of the composition can result in less than desirable efficiency of the opacification system thus leading to the formation of small localized spots in the final image due to additional light striking the photosensitive element before development is substantially completed. These small localized spots may appear as red and yellow dots in color films and as white dots in black and white films. It is thought that such spots may be due to less efficient light scattering by agglomerates of light-reflecting pigments thus allowing some incident light to reach the photosensitive layer(s) before photographic development is completed. It has been found that the use of alumina-free titanium dioxide in accordance with the invention can eliminate, substantially completely, any such pinpoint opacification defects in images formed with such integral diffusion transfer film units.

As pointed out previously, the use of the alumina-free titanium dioxide in accordance with the invention can also provide advantages in the manufacture of the processing composition. The processing compositions can be manufactured at room temperature thus substantially reducing the time required for the process. In addition, it has been found that the use of alumina-free titanium dioxide can provide a significant benefit by substantially reducing or eliminating rheological changes in the processing composition with time thus leading to lesser time dependent variability in parameters such as color balance, sensitometry and coverage.

In a preferred embodiment according to the invention, the processing composition further includes relatively small amounts, i.e., up to about 0.2% by weight, of aluminum hydroxide $Al(OH)_3$. It has been found that the addition of aluminum hydroxide to the processing composition in conjunction with alumina-free titanium dioxide, in diffusion transfer film units which include clearing agents capable of reducing the light-absorbing capacity of an optical filter agent can provide improvement in the rate of decolorization, that is, a visible increase in the brightness of the developing image during the first minute of development. Thus, a viewer observing the image forming in the film unit will see the developing image more quickly. As discussed previously, it is known to incorporate optical filter agents in the processing composition of diffusion transfer photographic film units where the exposed film is ejected from the camera immediately following the initiation of photographic development which is then allowed to continue in the ambient light.

The concentrations of the light-reflecting pigment and the optical filter agent are chosen such that the layer of aqueous alkaline processing composition is sufficiently opaque to ambient light incident upon the film unit. The light-absorbing capacity of the optical filter agent is cleared after this capacity is no longer needed, so that the optical filter agent need not be removed from the film unit, i.e., the optical filter agent will not exhibit any visible absorption which could degrade the transfer image or the white background provided by the reflecting layer.

Methods for "discharging" or "clearing" the light-absorbing capacity of particular optical filter agents are known in the art, such as, for example, as described in U.S. Pat. No. 4,298,674 where the optical filter agent, i.e., a pH-sensitive dye, is cleared by: (1) a pH reduction effected by an acid-reacting reagent, or, (2) a neutral polymeric material or a polyether polymer, the materials being appropriately positioned within the film unit such that neither the acid-reacting reagent nor the neutral polymeric material or the polyether polymer reduce the pH within the processing composition layer nor cause premature reduction in the light-absorbing capacity of the optical filter agent therein. U.S. Pat. No. 4,298,674 describes the addition of certain suitable decolorizing agents, such as, for example, a polyoxyethylene polyoxypropylene block copolymer or a polyoxyethylene polymer, e.g., nonylphenoxypolyoxyethylene, which "decolorize" or "clear" the pH-sensitive optical filter agent. U.S. Pat. No. 5,747,219 discloses a clearing system comprising nonylphenoxypolyoxyethylene and polyoxyethylene stearate.

The diffusion transfer photographic processing compositions of the invention generally comprise an aqueous dispersion of a highly aklaline material such as potassium hydroxide, sodium hydroxide or the like, a silver solvent, a thickening agent and alumina-free titanium dioxide. The processing composition for black and white diffusion transfer film units also includes a silver halide developing agent. The processing compositions include any suitable amount of alumina-free titanium dioxide, typically from about 0.1% to about 50%, by weight, dependent primarily upon various factors such as the type of diffusion transfer film unit and the results desired. The processing compositions of the invention may include various other components as is known in the art such as optical filter agents, development accelerators, antifoggants, post-processing transfer inhibitors and inorganic materials such as silica. In a preferred embodiment the processing composition includes from about 35% to about 45%, by weight, of alumina-free titanium dioxide and, in a particularly preferred embodiment, from about 40% to about 42%, by weight, of alumina-free titanium dioxide.

The novel method of the present invention for processing a diffusion transfer photographic film unit, including the integral and peel-apart types, may be used in conjunction with any photographic emulsion, and may be used to process any exposed photosensitive element including photographic systems for forming images in black and white or in color and those wherein the final image is a metallic silver image or one formed by other image-forming materials, such as, for example, image dye-providing materials. Image-recording elements useful in both black and white and color photographic imaging systems, integral and peel-apart, are well known in the art and, therefore, extensive discussion of such materials is not necessary here. It should be noted, however, that although the diffusion transfer film unit of the present invention is preferably used in photographic systems which include a rupturable container or "pod," as is known in the art, which releasably contains the aqueous alkaline processing composition; nonetheless, the diffusion transfer film unit of the present invention may also be used in photographic systems which do not utilize a pod.

In addition, the novel method of the present invention may be used in conjunction with any photographic emulsion. In the preferred diffusion transfer film units of the invention, it is preferred to include a negative working silver halide emulsion, i.e., one which develops in the areas of exposure. Further, the novel method of the present invention may be used in association with any image dye-providing materials, for example, complete dyes or dye intermediates, e.g., color couplers, or dye-developers. The dye developers contain, in the same molecule, both the chromophoric system of a dye and a silver halide developing function as is described in U.S. Pat. No. 2,983,606.

In a particularly preferred embodiment the diffusion transfer photographic film elements of the invention include one or more image dye-providing materials which may be initially diffusible or nondiffusible. In diffusion transfer photographic systems the image dye-providing materials which can be utilized generally may be characterized as either (1) initially soluble or diffusible in the processing composition but which are selectively rendered nondiffuisible imagewise as a function of development or (2) initially insoluble or nondiffusible in the processing composition but which selectively provide a diffusible product imagewise as a function of development. The requisite differential in mobility or solubility may be obtained, for example, by a chemical reaction such as a redox reaction as is the case with dye developers, a coupling reaction or by a silver-assisted cleavage reaction as is the case with thiazolidines. As noted previously, more than one image-forming mechanism may be utilized in the multicolor diffusion transfer film units of the present invention.

Other image dye-providing materials which may be used include, for example, initially diffusible coupling dyes such as are useful in the diffusion transfer process described in U.S. Pat. No. 2,087,817 which are rendered nondiffusible by coupling with the oxidation product of a color developer; initially nondiffusible dyes which release a diffusible dye following oxidation, sometimes referred to as "redox dye releaser" dyes, described in U.S. Pat. Nos. 3,725,062 and 4,076,529; initially nondiffusible image dye-providing materials which release a diffusible dye following oxidation and intramolecular ring closure as are described in U.S. Pat. No. 3,433,939 or those which undergo silver assisted cleavage to release a diffusible dye in accordance with the disclosure of U.S. Pat. Nos. 3,719,489 and 5,569,574; and initially nondiffusible image dye-providing materials which release a diffusible dye following coupling with an oxidized color developer as described in U.S. Pat. No. 3,227,550. In a particularly preferred embodiment of the invention the image dye-providing materials are dye-developers which are initially diffusible materials.

U.S. Pat. Nos. 3,719,489 and 4,098,783 disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound. For convenience, these compounds may be referred to as "image dye-releasing thiazolidines". The same release mechanism is used for all three image dyes, and, as will be readily apparent, the image dye-forming system is not redox controlled.

U.S. Pat. No. 5,569,574 discloses diffusion transfer processes wherein a diffusible image dye is released from an immobile precursor by silver-initiated cleavage of certain sulfur-oxygen containing compounds, preferably, a 1,3-sulfur-oxygen ring system.

A diffusion transfer film unit which utilizes two different imaging mechanisms, namely dye developers and image dye-releasing thiazolidines, is described in U.S. Pat. Nos. 4,740,448; 4,777,112; 4,794,067 and 5,422,233. In such film units the image dye positioned the greatest distance from the image-receiving layer is a dye developer and the image dye positioned closest to the image-receiving layer is provided by an image dye-releasing thiazolidine. The other image dye-providing material may be either a dye developer or an image dye-releasing thiazolidine. Particularly preferred diffusion transfer film units according to the present invention include, as image dye-providing materials, both dye developers and dye-providing thiazolidine compounds as described in U.S. Pat. Nos. 4,740,448; 4,777,112; 4,794,067 and 5,422,233.

The diffusion transfer photographic systems utilizing the diffusion transfer film units of the present invention may include any of the known diffusion transfer multicolor films. Particularly preferred diffusion transfer photographic film units according to the invention are those intended to provide multicolor dye images. The most commonly employed photosensitive elements for forming multicolor images are of the "tripack" structure and contain blue-, green- and red-sensitive silver halide emulsion layers each having associated therewith in the same or a contiguous layer a yellow, a magenta and a cyan image dye-providing material, respectively.

Suitable photosensitive elements and their use in the processing of diffusion transfer photographic images are well known and are disclosed, for example, in U.S. Pat. No. 2,983,606; and in U.S. Pat. Nos. 3,345,163 and 4,322,489.

U.S. Pat. No. 2,983,606 discloses a subtractive color film which employs red-sensitive, green-sensitive and blue-sensitive silver halide layers having associated therewith, respectively, cyan, magenta and yellow dye developers. In such films, oxidation of the dye developers in exposed areas and consequent immobilization thereof has provided the mechanism for obtaining imagewise distribution of unoxidized, diffusible cyan, magenta and yellow dye developers which are transferred by diffusion to an image-receiving layer. While a dye developer itself may develop exposed silver halide, in practice the dye developer process has utilized a colorless developing agent, sometimes referred to as an "auxiliary" developer, a "messenger" developer or an "electron transfer agent", which developing agent develops the exposed silver halide. The oxidized developing agent then participates in a redox reaction with the dye developer thereby oxidizing and immobilizing the dye developer in imagewise fashion. A well known messenger developer has been 4'-methylphenylhydroquinone.

The diffusion transfer photographic materials of the present invention include those wherein the photosensitive silver halide emulsion layer(s) and the image-receiving layer are initially contained in separate elements which are brought into superposition subsequent or prior to exposure. Alternatively, the photosensitive layer(s) and the image-receiving layer may initially be in a single element wherein the negative and positive components are retained together in an integral structure. In either case, after development the two elements may be retained together in a single film unit, i.e., an integral negative-positive film unit, or separated from each other, i.e., a peel-apart film unit.

As stated above, the multicolor diffusion transfer photographic film units of the invention include those where the photosensitive element and the image-receiving element are maintained in superposed relationship before, during and after exposure as described in U.S. Pat. No. 3,415,644. In commercial embodiments of this type of film (e.g., SX-70 film) the support for the photosensitive element is opaque, the support for the image-receiving element is transparent and a light-reflecting layer against which the image formed in the image-receiving layer may be viewed is formed by distributing a layer of processing composition containing a light-reflecting pigment (titanium dioxide) between the superposed elements. By also incorporating suitable pH-sensitive optical filter agents, preferably pH-sensitive phthalein dyes, in the processing composition, as described in U.S. Pat. No. 3,647,347, the film unit may be ejected from the camera immediately after the processing composition has been applied with the process being completed in ambient light while the photographer watches the transfer image emerge. As is known in the art, the concentrations of the light-reflecting pigment and the optical filter agent are chosen such that the layer of photographic processing composition comprising these components is sufficiently opaque to light actinic to the, e.g., silver halide emulsion, derived from, for example, ambient light incident to and transmitted through the transparent support of the image-receiving element of the integral film unit.

As is also known in the art, the light-absorbing capacity of the optical filter agent is "cleared" or substantially reduced after this capacity is no longer needed, as described in, for example, U.S. Pat. No. 4,298,674, so that the optical filter agent need not be removed from the film unit, i.e., the optical filter agent will not exhibit any visible absorption which could degrade the transfer image or the white background provided by the reflecting layer. In embodiments of the present invention wherein the diffusion transfer photographic film unit includes a light-reflecting pigment and an optical filter agent, any suitable method of clearing the light-absorbing capacity of the optical filter agent may be employed, including, for example, and preferably, the use of a layer comprising nonylphenoxypolyoxyethylene and polyoxyethylene stearate as disclosed and claimed in U.S. Pat. No. 5,747,219.

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye-providing material may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. It should be noted that the particular image component may contain other layers such as interlayers and timing layers.

In another embodiment of a film unit according to the invention, there are utilized silver halide emulsion layers which are sensitized to wavelengths of light substantially different than those absorbed by the image dye-providing material associated therewith. Such systems, often referred to as "false color systems" may utilize, for example, silver halide layers sensitized to infrared wavelengths of light, typically generated by a laser, for releasing visibly colored image dye-providing materials. Such systems preferably have two or three silver halide layers sensitized to different wavelengths of the infrared region and associated with differently colored image dye-providing materials.

As stated earlier, the present invention may be practiced with any multicolor diffusion transfer photographic film units and these film units may include any image dye-providing materials. In the particularly preferred embodiments of the invention the cyan and magenta image dyes are dye developers and the yellow image dye is a thiazolidine. In a particularly preferred embodiment the red sandwich, or image component, is positioned closest to the support for the photosensitive element and the blue image component is positioned farthest from the support of the photosensitive element and closest to the image-receiving layer.

Briefly, for example, a preferred embodiment of a diffusion transfer photographic film unit generally includes: a support; at least one silver halide emulsion layer; an image-receiving layer; an aqueous alkaline processing composition; and alumina-free titanium dioxide.

A preferred embodiment of a diffusion transfer photographic film unit of the present invention includes: (1) a photosensitive element comprising a support carrying at least one silver halide emulsion layer; (2) an image-receiving element comprising a support carrying an image-receiving layer; and (3) a rupturable container releasably holding a photographic processing composition including alumina-free titanium dioxide, and so positioned as to be adapted to distribute the photographic processing composition between predetermined layers of the elements.

In addition, a preferred embodiment of a diffusion transfer photographic film unit wherein the photosensitive and the image-receiving elements are designed to be separated from each other after development generally includes: (1) a photosensitive element comprising a support carrying at least one silver halide emulsion layer; (2) an image-receiving element comprising a support carrying an image-receiving layer, a polymeric acid reacting layer, a timing layer, an overcoat layer and a stripcoat layer; and (3) a rupturable container releasably holding a photographic processing composition including alumina-free titanium dioxide, and so positioned as to be adapted to distribute the photographic processing composition between predetermined layers of the elements.

A preferred embodiment of a diffusion transfer photographic film unit wherein the image-receiving element is designed to be retained with the photosensitive element after exposure and photographic processing generally includes: (1) a photosensitive element comprising a support carrying at least one silver halide emulsion layer, a polymeric acid reacting layer, and a timing layer; (2) an image-receiving element comprising a transparent support and carrying an image-receiving layer, and which is superposed or superposable on the photosensitive element; and (3) a rupturable container releasably holding an aqueous alkaline processing composition including alumina-free titanium dioxide, and so positioned as to be adapted to distribute said processing composition between predetermined layers of the elements, all prepared as described herein.

In another preferred embodiment of a diffusion transfer photographic film unit wherein the image-receiving element is designed to be retained with the photosensitive element after exposure and photographic processing generally includes: (1) a photosensitive element comprising a support carrying at least one silver halide emulsion layer, a polymeric acid-reacting layer and a timing layer; (2) an image-receiving element comprising a transparent support and carrying an image-receiving layer, and which is superposed or superposable on the photosensitive element; and (3) a rupturable container releasably holding an aqueous alkaline processing composition comprising alumina-free titanium dioxide, and so positioned as to be adapted to distribute the processing composition between predetermined layers of the elements, all prepared as described herein.

In another preferred embodiment of a diffusion transfer photographic film unit wherein the image-receiving element is designed to be retained with the photosensitive element after exposure and photographic processing generally includes: (1) a photosensitive element comprising a support carrying at least one silver halide emulsion layer, a polymeric acid-reacting layer and a timing layer; (2) an image-receiving element comprising a transparent support and carrying an image-receiving layer and a layer comprising nonylphenoxypolyoxyethylene, polyoxyethylene stearate and polyvinylpyrrolidone, as disclosed and claimed in copending, commonly-assigned U.S. Pat. No. 5,747,219, and which is superposed or superposable on the photosensitive element; and (3) a rupturable container releasably holding an aqueous alkaline processing composition comprising alumina-free titanium dioxide and a light-absorbing optical filter agent, and so positioned as to be adapted to distribute the processing composition between predetermined layers of the elements, all prepared as described herein.

Further, the photosensitive element in any of the preferred embodiments mentioned above preferably includes an image dye-providing material in association with said silver halide emulsion layer(s). Moreover, the photosensitive element preferably includes a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

Each of the layers carried by the support(s) of the diffusion transfer photographic film units of the invention functions in a predetermined manner to provide desired diffusion transfer photographic processing as is well known in the art. It should also be understood that the image-receiving element may include additional layers such as a strip-coat layer, e.g., as disclosed and claimed in U.S. Pat. No. 5,346,800, and an overcoat layer, e.g., as disclosed and claimed in U.S. Pat. No. 5,415,969, and as is known in the art. In embodiments of the present invention wherein the diffusion transfer photographic film unit is of the peel-apart type, it is preferred to include a strip-coat layer.

Support material can comprise any of a variety of materials capable of carrying the other layers of image-receiving element. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, the nature of support material as a transparent, opaque or translucent material will be a matter of choice. Typically, an image-receiving element adapted to be used in peel-apart diffusion transfer film units and designed to be separated after processing will be based upon an opaque support material.

The support material of the image-receiving element shown in Example I herein is a transparent material for production of a photographic reflection print, and it will be appreciated that the support will be a transparent support material where the processing of a photographic transparency is desired. In one embodiment where the support material is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer can be viewed as a transparency. As mentioned previously, since the support material of the image-receiving element is a transparent sheet, opacification materials such as carbon black and titanium dioxide can be incorporated in the processing composition to permit in-light development.

As mentioned above, the preferred diffusion transfer photographic film units of the invention include a pressure-rupturable container. Such pods and like structures are common in the art and generally define the means for providing the photographic processing composition to the, e.g., photosensitive element and image-receiving element. The processing composition typically comprises an aqueous alkaline composition which generally includes a silver halide developing agent and a silver halide solvent and may include other addenda as is known in the art. Examples of such aqueous alkaline processing compositions are found in U.S. Pat. Nos. 3,445,685; 3,597,197; 4,680,247; 4,756,996 and 5,422,233, as well as the patents cited therein.

In addition, the aqueous alkaline processing compositions utilized in the diffusion transfer photographic film units of the present invention may include one or more of the acylpyridine-N-oxide compounds disclosed and claimed in U.S. Pat. No. 5,604,079, and/or inosine as disclosed and claimed in U.S. Pat. 5,756,253.

As mentioned earlier, the photosensitive system referred to above comprises a photosensitive silver halide emulsion. In a preferred color embodiment of the invention a corresponding image dye-providing material is provided in conjunction with the silver halide emulsion. The image dye-providing material is capable of providing, upon processing, a diffusible dye which is capable of diffusing to the image-receiving layer as a function of exposure. As described previously, preferred photographic diffusion transfer film units are intended to provide multicolor dye images and the photosensitive element is preferably one capable of providing such multicolor dye images. In a preferred black and white embodiment, the image-forming material utilized is complexed silver which diffuses from the photosensitive element to the image-receiving layer during processing. Moreover, the image-receiving layer utilized in such black and white embodiments typically includes silver nucleation materials. As stated earlier, both such photosensitive systems are well known in the art.

Briefly, however, in the black and white diffusion transfer film units of the present invention, a photosensitive element including a photosensitive silver halide emulsion is exposed to light and subjected to an aqueous alkaline solution comprising a silver halide developing agent and a silver halide solvent. The developing agent reduces exposed silver halide to an insoluble form and the unexposed silver halide, solubilized by the silver solvent, migrates to an image-receiving element. The image-receiving element of these film units typically comprises a support and an image-receiving layer including a silver precipitating material such as that referred to above wherein the soluble silver complex is precipitated or reduced to form a visible silver black and white image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991 and 3,607,269 and in E. H. Land, H. G. Rogers, and V. K. Walworth, in J. M. Sturge, ed., *Neblette's Handbook of Photography and Reprography,* 7th ed., Van Nostrand Reinhold, New York, 1977, pp. 258–330.

As mentioned previously, in a preferred embodiment, the photosensitive element of the diffusion transfer photographic film unit of the present invention includes a polymeric acid-reacting layer. The polymeric acid-reacting layer reduces the environmental pH of the film unit, subsequent to transfer image formation. As disclosed, for example, in U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Thus, reduction in the environmental pH of the film unit is achieved by the conduct of a neutralization reaction between the alkali provided by the processing composition and a layer which comprises immobilized acid-reactive sites and which functions as a neutralization layer. Preferred polymers such a neutralization layer comprise such polymeric acids as cellulose acetate hydrogen phthalate; polyvinyl hydrogen phthalate; polyacrylic acid; polystyrene sulfonic acid; and maleic anhydride copolymers and half esters thereof.

Further, a polymeric acid-reacting layer can be applied, if desired, by coating the support layer with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of a polymeric acid-reacting layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, as described in U.S. Pat. No. 3,756,815. As examples of useful polymeric acid-reacting layers, in addition to those disclosed in the U.S. Pat. Nos. 3,362,819 and 3,756,815, mention may be made of those disclosed in U.S. Pat. Nos. 3,415,644; 3,754,910; 3,765,885; 3,819,371 and 3,833,367.

Any suitable inert interlayer or spacer layer may be used in association with the polymeric acid layer to control or "time" the pH reduction so that it is not premature which would interfere with the development process. Suitable spacer or "timing" layers useful for this purpose are described with particularity in U.S. Pat. Nos. 3,362,819; 3,419,389; 3,421,893; 3,455,686; 3,575,701; 4,201,587; 4,288,523; 4,297,431; 4,391,895; 4,426,481; 4,458,001; 4,461,824; 4,457,451 and 5,593,810. It is preferred to include a timing layer in a diffusion transfer photographic film unit of the present invention which includes a polymeric acid-reacting layer.

As mentioned earlier, any suitable image-receiving layer which is designed for receiving an image-forming material which diffuses in an imagewise manner from the photosensitive element during processing may be used in the present invention. In color embodiments of the present invention, the image-receiving layer generally comprises a dyeable material which is permeable to the alkaline processing composition. The dyeable material may comprise polyvinyl alcohol together with a polyvinyl pyridine polymer such as poly(4-vinyl pyridine). Such image-receiving layers are further described in U.S. Pat. No. 3,148,061.

Another suitable image-receiving layer material comprises a graft copolymer of 4-vinyl pyridine and vinylbenzyltrimethylammonium chloride grafted onto hydroxyethyl cellulose. Such graft copolymers and their use as image-receiving layers are further described in U.S. Pat. Nos. 3,756,814 and 4,080,346. Other suitable materials can, however, be employed.

For example, suitable mordant materials of the vinylbenzyl-trialkylammonium type are described, for example, in U.S. Pat. No. 3,770,439. Mordant polymers of the hydrazinium type (such as polymeric mordants prepared by quaternization of polyvinylbenzyl chloride with a disubstituted asymmetric hydrazine), e.g., those described in Great Britain Patent No. 1,022,207, published Mar. 9, 1966, can also be employed. One such hydrazinium mordant is poly(1-vinylbenzyl 1,1-dimethylhydrazinium chloride) which, for example, can be mixed with polyvinyl alcohol for provision of a suitable image-receiving layer.

Yet another suitable mordant material for use in an image-receiving layer is a terpolymer comprising trimethyl-, triethyl- and tridodecylvinylbenzyl-ammonium chloride, as described, for example, in U.S. Pat. Nos. 4,794,067; 5,591,560; and 5,593,809.

As stated earlier, the diffusion transfer photographic film units of the present invention may also include an overcoat layer, such as, for example, described in U.S. Pat. Nos. 5,415,969 and 5,633,114. Such an overcoat layer comprises a majority by dry weight of water-insoluble particles and a minority by dry weight of a binder material. The particles are substantially insoluble in water and non-swellable when wet. Furthermore, in order to minimize any light scatter by the overcoat layer, the particles typically have a small average particle size, for example, less than 300 nm and preferably less than 100 nm, and more preferably in the range of about 1 nm to 50 nm. The water-insoluble particles may comprise inorganic materials, e.g. colloidal silica, and/or organic materials, e.g. water-insoluble polymeric latex particles such as an acrylic emulsion resin. Colloidal silica is the preferred inorganic particle for use in such an overcoat layer, however, other inorganic particles may be used in combination or substituted therefor.

The binder material for the overcoat layer preferably comprises a water-insoluble latex material, however, the layer may comprise water soluble materials or combinations of water-insoluble and water soluble materials. Examples of applicable water soluble binder materials include ethylene acrylic acid, polyvinyl alcohol, gelatin, and the like.

One or more overcoat layers may be used in combination with other layers. Typically, each overcoat layer has a thickness of up to about 2 microns, and preferably between 1 and 1.5 microns. Such overcoat layers must allow suffi cient image-providing material to be transferred to the image-receiving layer to provide a photograph of the desired quality. Furthermore, in the peel-apart type diffusion transfer photographic film units of the present invention since the overcoat layer(s) remains upon the image-receiving element after processing and separation from the photosensitive element, the overcoat layer(s) should not scatter visible light to any appreciable degree since the photograph will be viewed through such layer(s).

In a preferred embodiment of the present invention the image-receiving element includes a layer comprising a copolymer of Petrolite® D300, which is commercially available from Petrolite Corporation (Tulsa, Okla.), and Polyox N3K, which is commercially available from Union Carbide Corporation (Danbury, Conn.), at a ratio of about 3:1, respectively, and Aerosol-OS, which is commercially available from American Cyanamid Corporation (Stamford, Conn.).

The invention will now be described further in detail with respect to specific preferred embodiments by way of an example, it being understood that this example is intended to be illustrative only and the invention is not limited to the materials, conditions, process parameters, etc. recited therein. All parts and percentages recited are by weight unless otherwise stated.

EXAMPLE I

Two (2) diffusion transfer photographic film units were prepared: one "test" film unit, i.e., a film unit prepared according to an embodiment of the present invention, and one "control" film unit, i.e., a film unit prepared in the same overall manner as the test film unit but with alumina-containing titanium dioxide versus alumina-free titanium dioxide.

More specifically, as will be described in detail below, the aqueous alkaline processing composition incorporated in the test diffusion transfer photographic film unit prepared according to embodiments of the present invention comprised alumina-free titanium dioxide (RUF) available from Bayer AG.

The photosensitive elements used in the control and the test diffusion transfer photographic film units described above comprised an opaque subcoated polyethylene terephthalate photographic film base carrying in succession:

1. a polymeric acid-reacting layer coated at a coverage of about 24,212 mg/m$^2$ comprising a 1.2/1 ratio of AIR-FLEX® 465 (a vinyl acetate ethylene latex available from Air Products Co.) and GANTREZ® S-97 (a free acid of a copolymer of methyl vinyl ether and maleic anhydride available from GAF Corp.);
2. a timing layer coated at a coverage of about 4075.5 Mg/m$^2$ comprising 4026.6 mg/m$^2$ of a copolymer of diacetone acrylamide and acrylamide grafted onto polyvinyl alcohol and 48.9 mg/m$^2$ of Aerosol-OS;
3. a cyan dye developer layer comprising about 500 mg/m$^2$ of the cyan dye developer represented by the formula

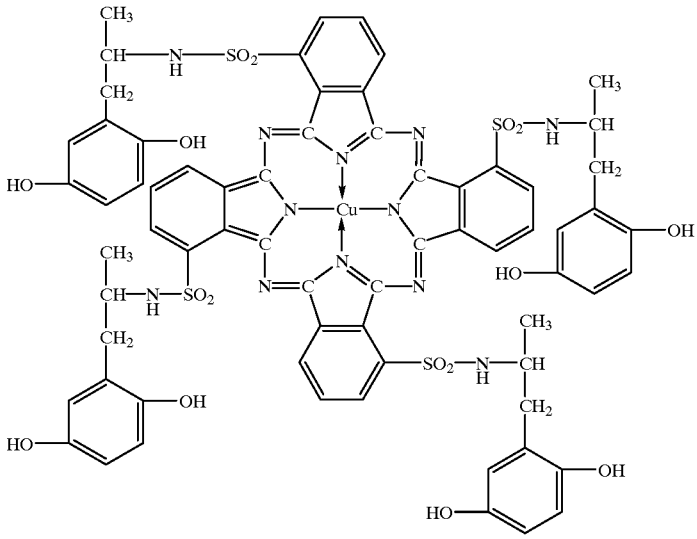

about 274 mg/m$^2$ of gelatin, and about 184 mg/m$^2$ of methylphenylhydroquinone

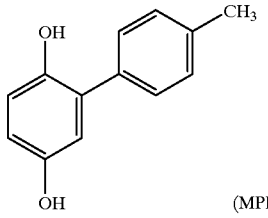

(MPHQ);

4. an interlayer comprising about 1000 mg/m$^2$ of titanium dioxide, about 374 mg/m$^2$ of a dispersion of polymethylmethacrylate beads (about 0.2 $\mu$m), about 124 mg/m$^2$ of gelatin, and about 374 mg/m$^2$ of a copolymer of butyl acrylate/diacetone acrylamide/methacrylic acid/styrene/acrylic acid;
5. a red-sensitive silver iodobromide layer comprising about 157 mg/m$^2$ of silver iodobromide (0.7 $\mu$m), about 525 mg/m$^2$ of silver iodobromide (1.5 $\mu$m), about 367 mg/m$^2$ of silver iodobromide (1.8 $\mu$m) and about 600 mg/m$^2$ of gelatin;
6. an interlayer comprising about 2976 mg/m$^2$ of a copolymer of butyl acrylate/diacetone acrylamide/methacrylic acid/styrene/acrylic acid and about 124 mg/m$^2$ of succindialdehyde;
7. a magenta dye developer layer comprising about 300 mg/m$^2$ of a magenta dye developer represented by the formula

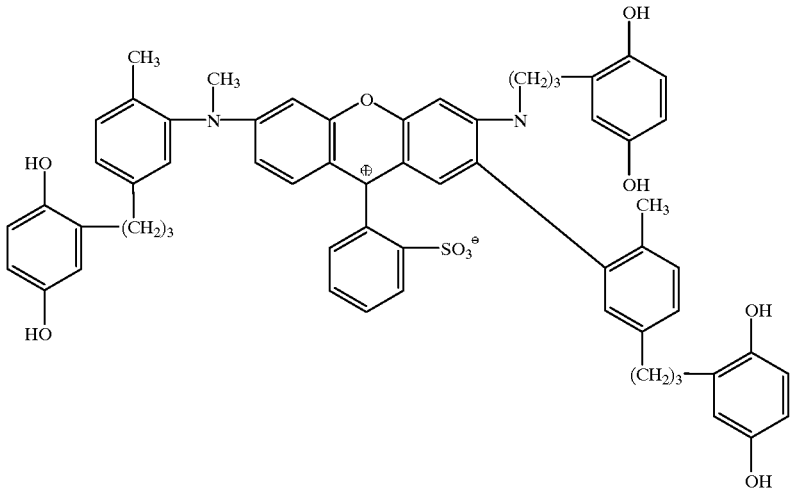

about 30 mg/m$^2$ of benzylaminopurine, about 200 mg/m$^2$ of a releasable antifoggant

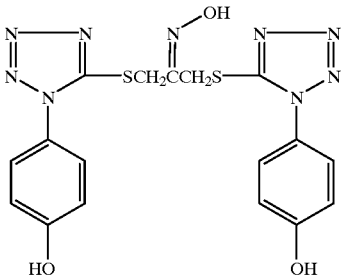

about 200 mg/m$^2$ of 2-phenyl benzimidazole and about 292 mg/m$^2$ of gelatin;

8. a layer comprising about 900 mg/m$^2$ of titanium dioxide, about 337 mg/m$^2$ of a dispersion of polymethylmethacrylate beads (about 0.2 $\mu$m), about 112 mg/m$^2$ of gelatin and about 337 mg/m$^2$ a copolymer of butyl acrylate/diacetone acrylamide/methacrylic acid/styrene/acrylic acid;

9. a green-sensitive silver iodobromide layer comprising about 220 mg/m$^2$ of silver iodobromide (1.1 $\mu$m), about 660 mg/m$^2$ of silver iodobromide (1.3 $\mu$m), about 220 mg/m$^2$ of silver iodobromide (1.5 $\mu$m) and about 484 mg/m$^2$ of gelatin;

10. a spacer layer comprising about 300 mg/m$^2$ tricrestylphosphate, about 136 mg/m$^2$ of MPHQ, about 136 mg/m$^2$ of a lactone developer represented by the formula

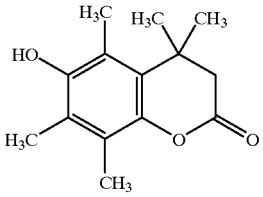

and about 249 mg/m$^2$ of gelatin;

11. an interlayer comprising about 1248 mg/m$^2$ of a copolymer of butyl acrylate/diacetone acrylamide/methacrylic acid/styrene/acrylic acid, and about 52 mg/m$^2$ of succindialdehyde;

12. a layer comprising about 1200 mg/m$^2$ of a scavenger (1-octadecyl-4,4-dimethyl-2-[2-hydroxy-5-(N-(7-caprolactamido)sulfonamido-phenyl] thiazolidine) and about 696 mg/m$^2$ of gelatin;

13. a yellow filter layer comprising about 400 mg/m$^2$ of a benzidine yellow dye, about 400 mg/m$^2$ of a polyvinylalcohol (Airvol® 325, available from Air Products Co.) and about 150 mg/m$^2$ of a hardener (available from R. H. Sands Corp. under the tradename OB 1207);

14. a yellow image dye-providing layer comprising about 420 mg/m$^2$ of a yellow image dye-providing material represented by the formula

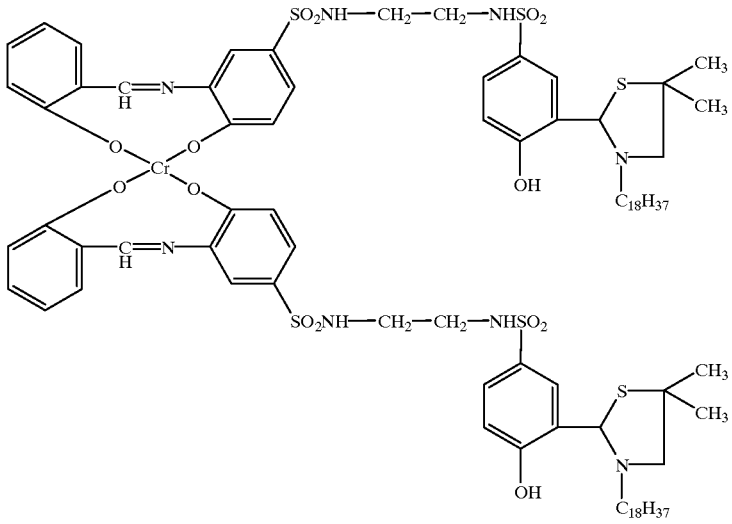

dispersed in Airvol, and about 280 mg/m$^2$ of gelatin;

15. a layer coated at a coverage of about 412 mg/m$^2$ of a tert-octylhydroquinone, about 206 mg/m$^2$ of dimethylterephthalamide, about 45 mg/m$^2$ of an oxidative release restrainer compound (available from Fairmont Chemical, Inc.) and about 300 mg/m$^2$ of gelatin;
16. a blue-sensitive silver iodobromide layer comprising about 235 mg/m$^2$ of silver iodobromide (1.3 $\mu$m) and about 118 mg/m$^2$ of gelatin; and
17. a layer comprising about 450 mg/m$^2$ of a dispersion of polymethylmethacrylate beads (about 0.2 $\mu$m), and about 350 mg/m$^2$ of gelatin.

The image-receiving elements used in the "control" and "test" diffusion transfer photographic film units comprised a transparent subcoated polyethylene terephthalate photographic film base carrying in succession:

1. an image-receiving layer coated at a coverage of about 2798 mg/m$^2$ comprising 2 parts of a terpolymer comprising vinylbenzyltrimethylammonium chloride, vinylbenzyltriethylammonium chloride and vinylbenzyldimethyldodecyl-ammonium chloride (6.7/3.3/1 weight %, respectively) and 1 part of gelatin, about 12.5 mg/m$^2$ of dimethyl-2,4-imidazolinedione, about 53.8 mg/m$^2$ of ammonium nitrate and about 10.8 mg/m$^2$ of polymethylmethacrylate beads (available from Anitec Image, from about 4 $\mu$m to about 7 $\mu$m);
2. a layer coated at a coverage of about 810 mg/m$^2$ comprising about 540 mg/m$^2$ of Igepal® CO-997 and about 270 mg/m$^2$ of Type NP K-90; and
3. a layer coated at a coverage of about 430 mg/m$^2$ comprising about 323 mg/m$^2$ of Petrolite® (D300) and about 108 mg/m$^2$ of Polyox N3K, a ratio of about 3:1, respectively, and about 21.5 mg/m$^2$ of 0.1% of Aerosol-OS.

The example film units were prepared utilizing the image-receiving elements and photosensitive elements as described above. In each case, after photoexposure of the photosensitive element, the image-receiving element and the photosensitive element were arranged in face-to-face relationship, i.e. (with their respective supports outermost) and a rupturable container containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements. The chemical composition of the aqueous alkaline processing composition utilized for the processing of the control film unit is set forth in TABLE I.

TABLE I

| COMPONENT | PARTS BY WEIGHT |
|---|---|
| optical filter agent[1] | 1.10 |
| 4-methyl-benzenesulfinic acid | 1.00 |
| 6-methyluracil | 0.59 |
| hydrophobically modified polyacrylic acid | 1.20 |
| trans-4-(aminoethyl) cyclohexane carboxylic acid | 0.15 |
| 2-amino-1,7-dihydro-6H-purine-6-one | 0.25 |
| potassium hydroxide | 5.92 |
| silica, aqueous dispersion | 0.31 |
| 1-(4-hydroxyphenyl)-2-tetrazoline-5-thione | 0.02 |
| optical filter agent[2] | 0.13 |
| 1-(phenyl-N-propyl)-2-ethylpyridinium bromide, 50% aqueous solution | 0.07 |
| 1H-1,2,4-triazole | 0.18 |
| 2-ethyl-1-(2-dioxanylethyl)pyridinium bromide, 50% aqueous solution | 1.06 |
| titanium dioxide, Dupont R101 | 42.0 |
| hypoxanthine | 0.76 |
| 2-ethyl-1H-imidazole | 1.68 |
| optical filter agent[3] | 0.11 |
| inosine | 0.30 |
| water | balance to 100 |

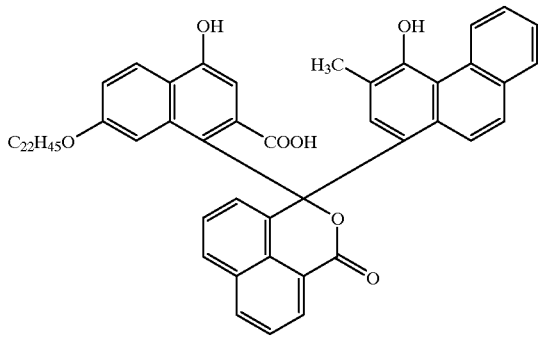

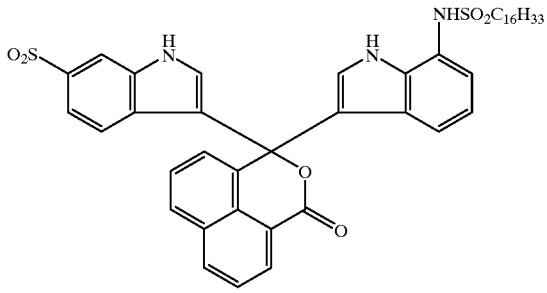

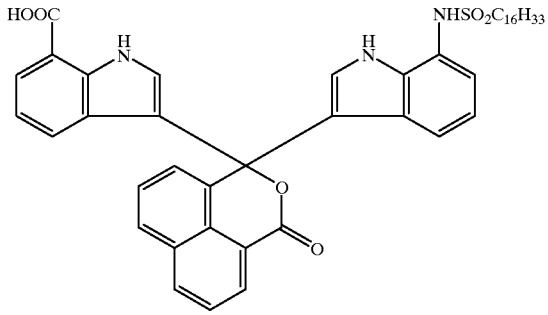

The aqueous alkaline processing composition incorporated in the test diffusion transfer photographic film unit further included about 42.0 parts by weight of alumina-free titanium dioxide (Bayer) in place of the listed alumina-containing titanium dioxide.

Each film unit, after exposure to a sensitometric target, was passed through a pair of rollers set at a gap spacing of about 0.0027 inches (0.069 mm) at room temperature, and the final image was viewed through the transparent support.

The red, blue and green maximum ($D_{max}$) and minimum ($D_{min}$) reflection densities which were read on a MacBeth Densitometer are shown in TABLE II below.

TABLE II

| | RED | | GREEN | | BLUE | |
|---|---|---|---|---|---|---|
| FILM UNIT | $D_{max}$ | $D_{min}$ | $D_{max}$ | $D_{min}$ | $D_{max}$ | $D_{min}$ |
| control | 200.8 | 0.14 | 209.0 | 0.17 | 183.2 | 0.14 |
| test | 200.1 | 0.15 | 204.1 | 0.19 | 178.1 | 0.15 |

The $D_{max}$ data show that both the control and the test diffusion transfer photographic film units allow sufficient image dye-providing materials to diffuse to the image-receiving layer. Also, the $D_{min}$ data show that both the control and the test diffusion transfer photographic film units provide photographs with acceptable backgrounds.

As determined by visual examination of the finished photographs generated from the diffusion transfer photographic film units of this Example, the photograph obtained with the control manifested pinpoint opacification defects (generally visible to the eye as bright red or yellow dots), whereas the use of an aqueous alkaline processing composition which includes alumina-free titanium dioxide according to the present invention, i.e., in the test photographic film unit, substantially eliminated such pinpoint opacification defects.

EXAMPLE II

A control and a test integral film unit were prepared in the same overall manner as described in Example I, except that, the processing composition of the test film unit further comprised aluminum hydroxide, $Al(OH)_3$, at about 0.1% by weight, in addition to the alumina-free titanium dioxide.

Each of the two film units was processed as described in Example I and the reflection densities are reported in TABLE III.

TABLE III

| | RED | | GREEN | | BLUE | |
|---|---|---|---|---|---|---|
| FILM UNIT | $D_{max}$ | $D_{min}$ | $D_{max}$ | $D_{min}$ | $D_{max}$ | $D_{min}$ |
| control | 187.8 | 0.16 | 207.3 | 0.17 | 180.0 | 0.14 |
| test | 178.9 | 0.16 | 201.8 | 0.17 | 178.2 | 0.14 |

The $D_{max}$ data show that both the control and the test diffusion transfer photographic film units allow sufficient image dye-providing materials to diffuse to the image-receiving layer. Also, the $D_{min}$ data show that both the control and the test diffusion transfer photographic film units provide photographs with acceptable backgrounds.

The photographs were examined visually both during development and after development was completed. The control photograph manifested some pinpoint opacification defects whereas there were substantially less defects in the test photograph. Further, the test photograph exhibited improvement in the rate of decolorization during the initial stage of development as evidenced by increased brightness of the image during the first minute of development.

EXAMPLE III

Diffusion transfer processing compositions according to the invention were stored at room temperature and at 120° F. and the rheological properties were measured over an extended period of time and compared with those of control processing compositions.

The viscosity measurements were made using a Paar Physica controlled stress rheometer. Two types of measurements were made, namely a controlled shear rate rotational flow curve and an oscillatory stress amplitude ramp.

The rotational flow curve measurements were made by placing a sample of the processing composition between a conical and a flat plate on the rheometer, ramping the speed of rotation of the cone to produce a shear rate in the sample of from 10 $sec^{-1}$ to 1000 $sec^{-1}$ and back to 10 $sec^{-1}$ and measuring the stress required to turn the cone. From these data a plot of shear stress vs. shear rate was generated and the viscosity at each shear rate calculated. The area between the upper and lower curves (the "thixotropic area") was also measured. The values for viscosity at 10 $sec^{-1}$ (V10), and the thixotropic area ("Thix") were tabulated and are reported in the Tables.

An oscillatory measurement was used to determine the viscoelasticity of the composition. This measurement is made by placing a sample of the reagent between two parallel flat plates on the rheometer, applying an oscillating stress to one plate at a frequency of 2 Hz and measuring the resulting strain and phase angle differences. The viscous and elastic components of strain were calculated and a plot of complex viscosity and tan delta (tan delta=loss function=viscosity/elasticity) vs. applied stress was displayed. A tan delta value greater than 1 indicates that the flow characteristics of the processing composition are dominated by the viscosity ("liquid-like" behavior) whereas when the tan delta value is less than 1, the elasticity dominates the flow characteristics ("solid-like" behavior). The tan function is non-linear since the range from zero to 1 is equivalent to the range from 1 to ∞. The processing compositions were characterized by the real and imaginary (elastic) viscosities and tan delta at 163 Pa applied stress (typically below the yield point and at 460 Pa (above the yield point).

A. The results obtained with processing compositions which are substantially the same as those incorporated in the test and control film units described in Example I are shown in TABLE IV.

TABLE IV

| | V10 | | | Thix | | | Tan D 163 | | |
|---|---|---|---|---|---|---|---|---|---|
| Reagent | 1 day | 40 days | % change | 1 day | 40 days | % change | 1 day | 40 days | % change |
| control | | | | | | | | | |
| RT | 26.0 | 36.9 | 42 | 20.1 | 53.1 | 164 | 0.94 | 0.76 | −19 |
| 120° F. | 26.0 | 47.8 | 84 | 20.1 | 58.4 | 191 | 0.94 | 0.54 | −43 |
| test | | | | | | | | | |
| RT | 20.7 | 22.3 | 8 | 12.2 | 16.3 | 34 | 1.83 | 1.97 | 8 |
| 120° F. | 20.7 | 26.2 | 27 | 12.2 | 37.8 | 210 | 1.83 | 2.60 | 42 |

B. The results obtained with a processing composition according to the invention ("test") prepared for use with a black and white integral diffusion transfer photographic film unit and a control processing composition are shown in TABLE V.

TABLE V

| | V10 | | | Thix | | | Tan D 163 | | |
|---|---|---|---|---|---|---|---|---|---|
| Reagent | 1 day | 55 days | % change | 1 day | 55 days | % change | 1 day | 55 days | % change |
| control | | | | | | | | | |
| RT | 11.0 | 21.7 | 97 | 11.8 | 55.1 | 367 | 2.90 | 1.30 | −55 |
| 120° F. | 11.0 | 47.0 | 327 | 11.8 | 120.0 | 917 | 2.90 | 0.80 | −72 |
| test | | | | | | | | | |
| RT | 23.8 | 23.5 | −1 | 13.0 | 13.1 | — | 1.85 | 1.66 | −10 |
| 120° F. | 23.8 | 28.8 | 21 | 13.0 | 29.6 | 127 | 1.85 | 0.96 | −46 |

The data in Tables IV and V show that the control alkaline processing compositions exhibit a greater change in rheological properties with time, both in storage at room temperature and at 120° F., than did the test compositions which included alumina-free titanium dioxide according to the invention. The elevated temperature storage serves to accelerate reactions that normally occur over extended time periods. The thixotropic area ("Thix") has been found to correlate directly to pinpoint opacification defect levels in diffusion transfer photographs with Thix values greater than about 70 corresponding to relatively severe defect levels.

C. The results obtained with a processing composition according to the invention substantially identical to that described in Example I ("A"—alumina-free titanium dioxide) and a processing composition according to the invention substantially identical to that described in Example II ("B"—alumina-free titanium dioxide and aluminum hydroxide) are shown in TABLE VI.

TABLE VI

| | V10 | | | Thix | | | Tan D 163 | | |
|---|---|---|---|---|---|---|---|---|---|
| Reagent | 4 days | 30 days | % change | 4 days | 30 days | % change | 4 days | 30 days | % change |
| A | | | | | | | | | |
| RT | 28.7 | 29.7 | 3 | 20.2 | 21.9 | 8 | 1.13 | 0.78 | −31 |
| 120° F. | 28.7 | 32.2 | 12 | 20.2 | 27.6 | 37 | 1.13 | 0.60 | −44 |
| B | | | | | | | | | |
| RT | 40.1 | 42.5 | 6 | 36.0 | 40.0 | 11 | 0.57 | 0.58 | 2 |
| 120° F. | 40.1 | 41.0 | 2 | 36.0 | 48.7 | 35 | 0.57 | 0.60 | 5 |

These data show that the addition of aluminum hydroxide as $Al(OH)_3$ to the alkaline processing composition containing alumina-free titanium dioxide did not substantially affect the change in rheological properties with time, both when stored at room temperature and at 120° F. The addition of aluminum did, however, increase the viscosity, the thixotropic area and the elasticity (lower tan D) of the processing composition.

EXAMPLE IV

A comparison study was made of the number of pinpoint opacification defects visible with time, but, as early as a few minutes post-completion of development, on the images obtained from control and test film units substantially identical to those described in Example I. Briefly, thin gap determinations (which increase the pinpoint opacification defect levels) were made from an accelerated aging test by oven conditioning (140° F. for 3 days) two sets of six pods which contained either alumina-containing titanium dioxide (four) or alumina-free titanium dioxide (two); assembling the pods between the photosensitive element and the image-receiving element as described in Example I, but at a gap spacing between the respective elements of about 0.0016" (0.041 mm); processing the film unit in the dark by passing the film unit through a motorized lab roller; maintaining one processed set of pods in the dark and removing the other set of pods into ambient light, i.e., as where integral film is extruded from an instant camera; allowing for completion of development; and making a visual comparison of the control and test thin spreads developed into ambient light, and then, the results therefrom against the final images of the thin spreads kept in the dark. The data are reported in TABLE VII where level 0 represents substantially no pinpoint opacification defects, generally visible to the eye as as bright red or yellow dots.

TABLE VII

| TITANIUM DIOXIDE | PINPOINT OPACIFICATION DEFECTS (140° F., 3 days) |
|---|---|
| Alumina-containing $TiO_2$ (42%) | level $1^+$ |
| Alumina-containing $TiO_2$ (42%) | level 2 |
| Alumina-containing $TiO_2$ (40.5%) | level $2^-$ |
| Alumina-containing $TiO_2$ (40.5%) | level $2^+$ |
| Alumina-free $TiO_2$ (Bayer - 40.5%) | level 0 |
| Alumina-free $TiO_2$ (Kronos - 40.5%) | level 0 |

The data reported in TABLE VII show that the diffusion transfer film units developed with alumina-free titanium dioxide versus alumina-containing titanium dioxide showed substantially fewer, if any, pinpoint opacification defects in the final image obtained therewith.

EXAMPLE V

The rate of clearing brightness of two film units according to the invention, namely Test #1 which was identical to the test element described in Example I and Test #2 which was identical to the test element described in Example II, was compared to a control which was identical to the control test element described in Example I. The film units were exposed to a controlled white light source, processed by being passed through mechanized laboratory rollers and then placed under a sensing device (Minolta Model CR231) which read the brightness (L*) of the film unit at 15 second intervals.

The brightness values are calibrated to a scale of from 0 to 100 where 100 is the value assigned to the reading obtained from the white color space of a Munsell color standard. The results are shown in TABLE VIII.

TABLE VIII

| Film Unit | L* | | |
|---|---|---|---|
| | 15 sec | 30 sec | 45 sec |
| Control | 76 | 79 | 79 |
| Test #1 | 72 | 76 | 76 |
| Test #2 | 78 | 80 | 80 |

It can be seen that the rate of clearing brightness for the film unit (Test #1) which had a processing composition including alumina-free titanium dioxide was lower than the Control film unit whereas the rate of clearing brightness exhibited by the Test #2 film unit, which had a processing composition which included a small amount of aluminum hydroxide in addition to the alumina-free titanium dioxide, was higher.

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A method for forming a diffusion transfer image comprising the steps of:

exposing a photosensitive element comprising a first support carrying at least one silver halide emulsion layer to an imagewise pattern of radiation; and developing said exposed photosensitive element in the presence of alumina-free titanium dioxide by applying an aqueous alkaline processing composition whereby an image is formed on an image-receiving layer.

2. A method as defined in claim I wherein said image-receiving layer is carried by a second support.

3. A method as defined in claim 1 wherein said alumina-free titanium dioxide is present in said aqueous alkaline processing composition.

4. A method as defined in claim 3 wherein said processing composition comprises from about 0.10% to about 50%, by weight, of said alumina-free titanium dioxide.

5. A method as defined in claim 4 wherein said processing composition comprises from about 35% by weight to about 50% by weight of said alumina-free titanium dioxide.

6. A method as defined in claim 3 wherein said processing composition further includes up to about 0.2% by weight of aluminum hydroxide.

7. A method as defined in claim 1 wherein said photosensitive element comprises a blue sensitive silver halide emulsion layer in association with a yellow image dye-providing material, a green-sensitive silver halide emulsion layer in association with a magenta image dye-providing material and a red-sensitive silver halide emulsion layer in association with a cyan image dye-providing material.

8. A method as defined in claim 1 wherein said photosensitive element comprises two or three silver halide emulsion layers, each said silver halide emulsion layer sensitized to different wavelengths of the infrared region and each said silver halide emulsion layer being associated with a differently colored image dye-providing material.

9. A diffusion transfer photographic film unit which comprises: a support; a photosensitive element comprising at least one silver halide emulsion layer; an image-receiving layer; an aqueous alkaline processing composition; and alumina-free titanium dioxide.

10. A diffusion transfer film unit as defined in claim 9 wherein said image-receiving layer is carried by a second support.

11. A diffusion transfer film unit as defined in claim 9 wherein said alumina-free titanium dioxide is incorporated in said aqueous alkaline processing composition.

12. A diffusion transfer photographic film unit as defined in claim 11 wherein said processing composition comprises from about 0.10% by weight to about 50% by weight of said alumina-free titanium dioxide.

13. A diffusion transfer photographic film unit as defined in claim 12 wherein said processing composition comprises from about 35% by weight to about 50% by weight of said alumina-free titanium dioxide.

14. A diffusion transfer photographic film unit as defined in claim 11 wherein said processing composition further includes up to about 0.2% by weight of aluminum hydroxide.

15. A diffusion transfer photographic film unit as defined in claim 9 wherein said photosensitive element comprises a red-sensitive silver halide emulsion layer having a cyan image dye-providing material associated therewith, a green-sensitive silver halide emulsion layer having a magenta image dye-providing material associated therewith and a blue-sensitive silver halide emulsion layer having a yellow image dye-providing material associated therewith.

16. A diffusion transfer photographic film unit as defined in claim 9 wherein said photosensitive element comprises two or three silver halide emulsion layers, each said silver halide emulsion layer being sensitized to different wavelengths in the infrared region and each said silver halide emulsion layer being associated with a differently colored image dye-providing material.

17. An aqueous alkaline processing composition for use with a diffusion transfer photographic film unit which comprises: a thickening agent, a silver halide solvent, and alumina-free titanium dioxide.

18. A processing composition as defined in claim 17 which comprises from about 0.10% by weight to about 50% by weight of said alumina-free titanium dioxide.

19. A processing composition as defined in claim 19 which comprises from about 35% by weight to about 50% by weight of said alumina-free titanium dioxide.

20. A processing composition as defined in claim 17 and further including an optical filter agent.

21. A processing composition as defined in claim 20 and further including up to about 0.2% by weight of aluminum hydroxide.

* * * * *